US007257858B2

(12) United States Patent
Palazzolo

(10) Patent No.: US 7,257,858 B2
(45) Date of Patent: Aug. 21, 2007

(54) LEAF COLLECTION DEVICE

(76) Inventor: Giacomo S. Palazzolo, 510 Tomah Ave., Prospect Heights, IL (US) 60070

( * ) Notice: Subject to any disclaimer, the term of this patent is extended or adjusted under 35 U.S.C. 154(b) by 558 days.

(21) Appl. No.: 10/879,817

(22) Filed: Jun. 29, 2004

(65) Prior Publication Data

US 2005/0283942 A1 Dec. 29, 2005

(51) Int. Cl.
*A47L 9/14* (2006.01)

(52) U.S. Cl. ..... 15/347; 15/330; 15/246.2

(58) Field of Classification Search ..... 15/344, 15/347, 33, 246.2; 56/194, 203; 141/114, 141/316, 7, 65
See application file for complete search history.

(56) References Cited

U.S. PATENT DOCUMENTS

| | | | | |
|---|---|---|---|---|
| 1,170,960 | A | 2/1916 | Canterbury | |
| 1,402,697 | A | 1/1922 | Watkins | |
| 2,430,155 | A | 11/1947 | Buttery | |
| 2,740,445 | A | 4/1956 | Fornell | |
| 3,915,329 | A | 10/1975 | Zaks | |
| 3,934,803 | A | 1/1976 | Paulus, Jr. | |
| 3,942,832 | A | 3/1976 | Haas, Jr. | 294/55 |
| 4,200,127 | A | 4/1980 | Dunleavy | 141/10 |
| 4,491,212 | A | 1/1985 | Gray, Jr. | 193/7 |
| 4,713,858 | A | 12/1987 | Kelber | 15/347 |
| 5,011,103 | A | 4/1991 | Hayes et al. | 248/99 |
| 5,056,932 | A | 10/1991 | Young | 383/36 |
| 5,067,821 | A | 11/1991 | Young | 383/36 |
| 5,107,564 | A | 4/1992 | Grumbles | 15/257.1 |
| D334,448 | S | 3/1993 | Fish | D34/5 |
| 5,213,141 | A | 5/1993 | Dorman | 141/10 |
| D389,971 | S | 1/1998 | Zickenberg | D34/5 |
| 5,918,651 | A | 7/1999 | Gazdy et al. | 141/391 |
| 5,979,842 | A | 11/1999 | Fan | 248/99 |
| D417,762 | S | 12/1999 | Young | D34/1 |
| 5,996,999 | A | 12/1999 | Casely | 273/148 R |
| 6,029,312 | A * | 2/2000 | Whitney | 15/347 |
| 6,047,748 | A * | 4/2000 | Rooker | 141/316 |
| 6,116,548 | A | 9/2000 | Oleson | 248/97 |
| 6,135,518 | A | 10/2000 | Holthaus | 294/1.1 |
| 6,155,522 | A | 12/2000 | Anderson | 248/99 |
| D445,550 | S | 7/2001 | Wigren et al. | D34/6 |
| 6,318,594 | B1 | 11/2001 | Hutchins | 222/1 |
| D453,620 | S | 2/2002 | Vazquez | D3/244 |
| 6,367,747 | B1 | 4/2002 | Mulle | 248/99 |
| 6,415,713 | B1 | 7/2002 | Abrams | 100/246 |
| 6,450,461 | B1 | 9/2002 | Lohmann | 248/99 |
| 6,467,735 | B1 | 10/2002 | Clinton | 248/97 |
| 6,536,488 | B1 | 3/2003 | Pochobradsky | 141/390 |
| 6,554,810 | B1 | 4/2003 | Wilk et al. | 604/323 |
| 6,574,829 | B1 | 6/2003 | Marcum et al. | 15/347 |
| 6,651,942 | B1 | 11/2003 | Yardley et al. | 248/100 |
| D486,617 | S | 2/2004 | Binder et al. | D34/6 |

(Continued)

*Primary Examiner*—Theresa T. Snider
(74) *Attorney, Agent, or Firm*—Wood Phillips et al.

(57) ABSTRACT

An apparatus for facilitating the collection of leaves and/or yard debris using a portable vacuum device is provided. The apparatus includes a top surface and side walls defining an open-bottom chamber. An intake hose leading to the open-bottom chamber receives materials expelled from an exhaust outlet of the portable vacuum device and routes the expelled materials into the open-bottom chamber. The apparatus can be positioned within a yard waste disposal bag. When the apparatus has been filled with yard waste, it can be removed from the disposal bag, leaving the collected yard waste behind in the bag.

16 Claims, 6 Drawing Sheets

U.S. PATENT DOCUMENTS 6,988,293 B2 * 1/2006 Ritter ..... 15/347
7,066,220 B1 * 6/2006 Take et al. ..... 141/391
2005/0193517 A1 * 9/2005 Svoboda et al. ..... 15/347

* cited by examiner

LEAF COLLECTION DEVICE

BACKGROUND OF THE DISCLOSURE

1. Field of the Invention

The present invention relates in general to the collection of leaves and other yard debris, and specifically to a device to facilitate the deposition of leaves and other yard debris into a disposal bag.

2. Background Art

Leaves and other yard debris are commonly collected into receptacles, such as garbage cans or bags, for disposal. While leaves can be collected manually using a rake to collect leaves into piles and transfer the piles of leaves into disposal containers, this process is labor-intensive and can be time-consuming for individuals seeking to collect leaves from a large area containing a number of trees. A less labor-intensive technique for collecting leaves involves the use of a portable air blower to arrange the leaves into piles. However, such blower techniques still typically require the collection of leaves into piles, followed by the manual transfer of the leaves into containers for disposal.

More recently, portable leaf blowers have been equipped with a vacuum function, whereby a portable vacuum device can be configured to vacuum up leaves and deposit the leaves into a portable container attached to an exhaust port on the device. A mulching function can optionally be provided whereby the leaves drawn into the vacuum device are mulched, thereby reducing the volume of yard waste for disposal. Such leaf vacuum products are typically supplied with a small receptacle configured for easy portability, such that the receptacle can be carried around the yard by the user. Thus, prior to disposal, the leaves must still be transferred from the portable receptacle to another, typically larger container for disposal.

Therefore, an apparatus that permits the direct transfer of leaves from a leaf vacuum into a disposal receptacle may be desirable in many applications. Furthermore, it may be desirable to provide an apparatus that is adapted to operate in conjunction with a wide variety of standard portable leaf vacuum units, without requiring proprietary features.

The disposal of leaves and other yard waste is also commonly subject to regulations implemented by many towns and local governments. Amongst such regulations may be requirements to use particular yard waste disposal bags. Therefore, it may also be desirable to provide a device which can deposit leaves and yard waste into a variety of different disposal bags or other receptacles.

SUMMARY OF THE INVENTION

A device is provided for the collection of items such as leaves or other yard waste. The device can be used with a portable vacuum unit having a discharge outlet from which leaves or other yard waste can be expelled. The device includes a top surface and side walls forming an open-bottom chamber, and can be inserted into a receptacle into which leaves are to be deposited. The device further includes an intake hose leading to the chamber formed by the top surface and side walls. The other end of the intake hose can be connected to the exhaust outlet of the portable vacuum unit. One or more support legs are positioned along the surface of the side walls.

The top surface and side walls can be made from a flexible woven material that is permeable to air, but which does not permit the passage of yard waste through the material, such as canvas. The top surface may include an access aperture such as a zipper, through which the user can gain access to the chamber formed by the device, which may be used to manually compress the collected yard waste or to insert additional debris.

The support legs may be made from a rigid metal rod material. The support legs can each be a single length of material, or they may be divided into a plurality of segments, such as to permit folding of the legs for compact storage. A top surface support member may also be attached to the perimeter of the top surface. The top surface support may be made from a rigid metal rod material.

The intake hose may include a fastener mechanism, adapted to permit interconnection with the exhaust outlet of a portable leaf vacuum. One type of fastener that may be employed is a ring of hook-and-loop fastener material around the inside perimeter of the intake hose, capable of being removably secured to a ring of complementary hook-and-loop fastener material circumscribing the exterior perimeter of the portable leaf vacuum exhaust outlet. Another type of fastener that may be employed is a pinch clamp positioned to circumscribe the exterior perimeter of the intake hose, thereby securing the intake hose to a leaf vacuum exhaust port inserted therein.

Also disclosed is a method for collecting leaves and/or other yard debris. The method includes the step of inserting into a leaf receptacle a leaf conduit device such as is described above. The exhaust outlet of a portable vacuum device is attached to an open end of the leaf conduit intake hose. The portable vacuum device is then used to vacuum up leaves and/or other yard debris and expel the leaves and/or debris through the exhaust outlet, through the intake hose and into the open-bottom chamber. Once the leaf conduit device is full, the device is lifted out of the leaf receptacle, leaving the contents of the open-bottom chamber behind in the leaf receptacle.

DETAILED DESCRIPTION OF THE INVENTION

Figure 1:
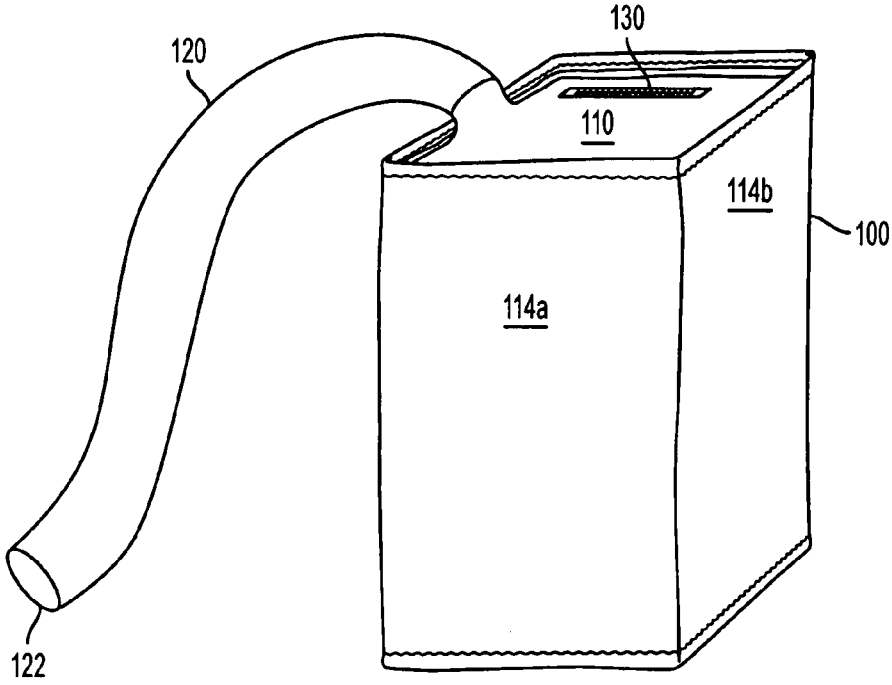
FIG. 1 is a perspective view of a leaf collection apparatus according to one embodiment of the invention.

While this invention is susceptible of embodiment in many different forms, there are shown in the drawings and will herein be described in detail, certain specific embodiments with the understanding that the present disclosure should be considered as an exemplification of the principles of the invention and is not intended to limit the invention to the embodiments so illustrated.

FIG. 1 is a side perspective view of a leaf collection apparatus, according to one embodiment of the invention. Leaf collection apparatus 100 forms an open-bottomed chamber generally rectangular in shape. The chamber is formed from four side walls 114*a-d* and top surface 110. Intake hose 120 extends from top surface 110 and is adapted for connection to the exhaust outlet of a leaf vacuum at intake port 122.

In the illustrated embodiment, side walls 114, top surface 110 and intake hose 120 are each comprised of canvas. Canvas is an effective material in many applications because it is porous to air, thereby preventing excessive buildup of pressure caused by the exhaust from a leaf blower, while containing leaves and limiting the amount of dirt and dust that passes through the chamber walls. Canvas is also a tough material that resists tearing and wear during extensive use. Of course, it is understood that other materials could be employed, such as synthetic woven nylon materials commonly used to contain grass clipping from gasoline-powered lawn mowers.

Figure 2:
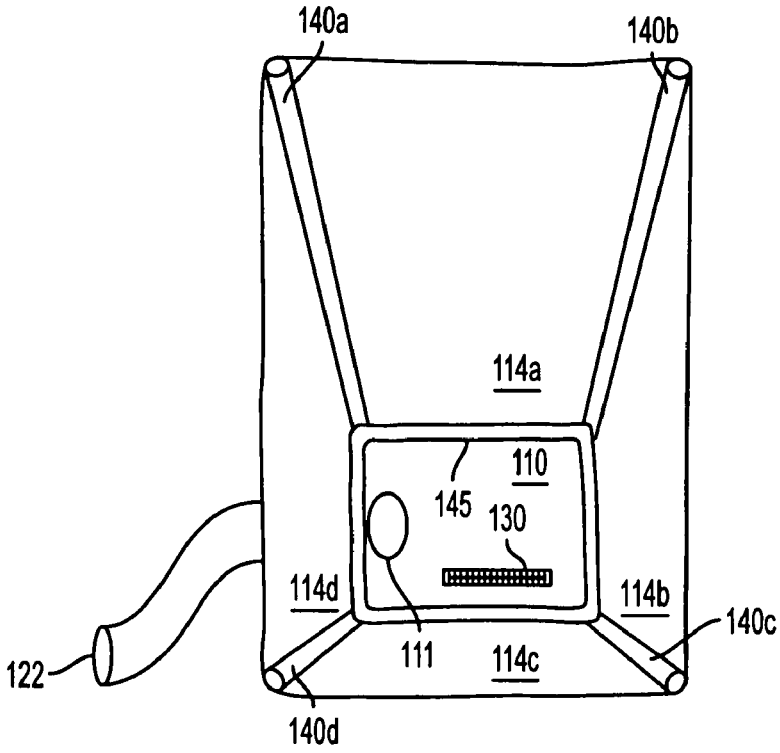
FIG. 2 is another perspective view, shown inverted, of the leaf collection apparatus according to the embodiment of FIG. 1.

FIG. 2 is a perspective view of leaf collection apparatus 100 shown inverted. Aperture 111 is provided in top surface 110, and leads to intake hose 120. The rectangular shape of leaf collection apparatus 100 is maintained by a support frame comprised of support legs 140*a-d* and top surface support 145. In the embodiment of FIGS. 1 and 2, support legs 140 and top surface support 145 are made of rigid metal rod. Top surface support 145 is generally rectangular in shape. Top surface 110 is pulled relatively tightly across top surface support 145 as attached, such that little slack is provided in top surface 110.

Support legs 140 run along the length of side walls 114, and are physically attached to side walls 114, such as through stitching or adhesive. Like support legs 140, top surface support 145 is physically attached to side walls 114 and top surface 110 at the junction thereof. However, in the illustrated embodiment, support legs 140 are not physically attached to top surface support 145. Therefore, since support legs 140 are held in position relative to top surface support 145 only by the flexible material of side walls 114 and top surface 110, the angle of support legs 140 relative to top surface 110 is readily adjustable, with their movement being constrained by the flexible material to which they are attached.

Figure 3:
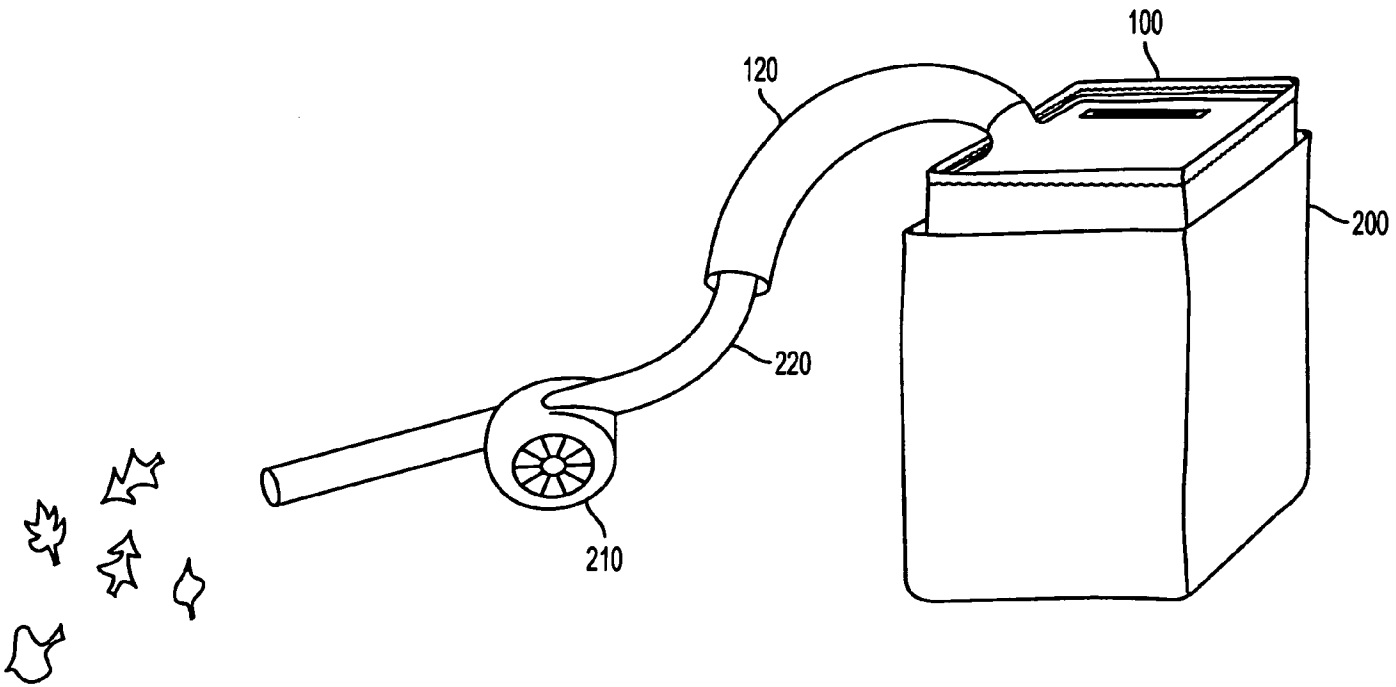
FIG. 3 is another perspective view of the leaf collection apparatus according to the embodiment of FIG. 1, operably connected to a leaf vacuum and engaged with a leaf disposal bag.

FIG. 3 illustrates leaf collection apparatus 100 in use. Apparatus 100 is positioned within leaf disposal bag 200. Top surface 110 generally covers the open top of leaf disposal bag 200, with support legs 140 running inside and down the length of bag 200. Intake hose 120 is connected to exhaust outlet 220 of leaf vacuum 210. In operation, leaf vacuum 210 sucks up leaves, optionally mulches them, and expels the leaves out of exhaust outlet 220. The flow of air and leaves out of exhaust outlet 220 forces the leaves down intake hose 120 and into the chamber formed by apparatus 100 and leaf disposal bag 200. Top surface 110 prevents leaves and dust from being expelled from the top of bag 200, while side surfaces 114 maintain close contact with the interior surfaces of bag 200 to further reduce leakage of dust, dirt and leaves. Optionally, bag 200 can be supported by a cart to facilitate the transport of bag 200 and leaf collection apparatus 100 around a yard during collection of yard waste.

As bag 200 begins to fill, the user can temporarily shut down leaf vacuum 210 and open zipper 130 to reach into bag 200 to manually compress or otherwise adjust the bag contents, thereby allowing the user to maximize the amount of material that is deposited into each bag. Zipper 130 can also be opened to manually insert sticks or other items into bag 200. Once zipper 130 has been closed again, the user can continue the operation of leaf vacuum 210 towards collecting further yard waste.

Once bag 200 has been filled with leaves and the like, leaf vacuum 210 is turned off and disconnected from leaf collection apparatus 100. Leaf collection apparatus 100 can then be lifted upwards out of bag 200. Because leaf collection apparatus 100 has an open bottom, the collected leaves are left behind within bag 200. Bag 200 can then be readily sealed and disposed of, thereby avoiding any need to transfer leaves into a different container.

Because leaf collection apparatus 100 has flexible side walls, it can be adapted to fit within disposable leaf bags or receptacles having a wide variety of shapes and sizes, while maintaining close contact between flexible side walls 114 and the interior side surfaces of the leaf bag or receptacle such that the escape of dust and dirt is reduced.

Figure 4:
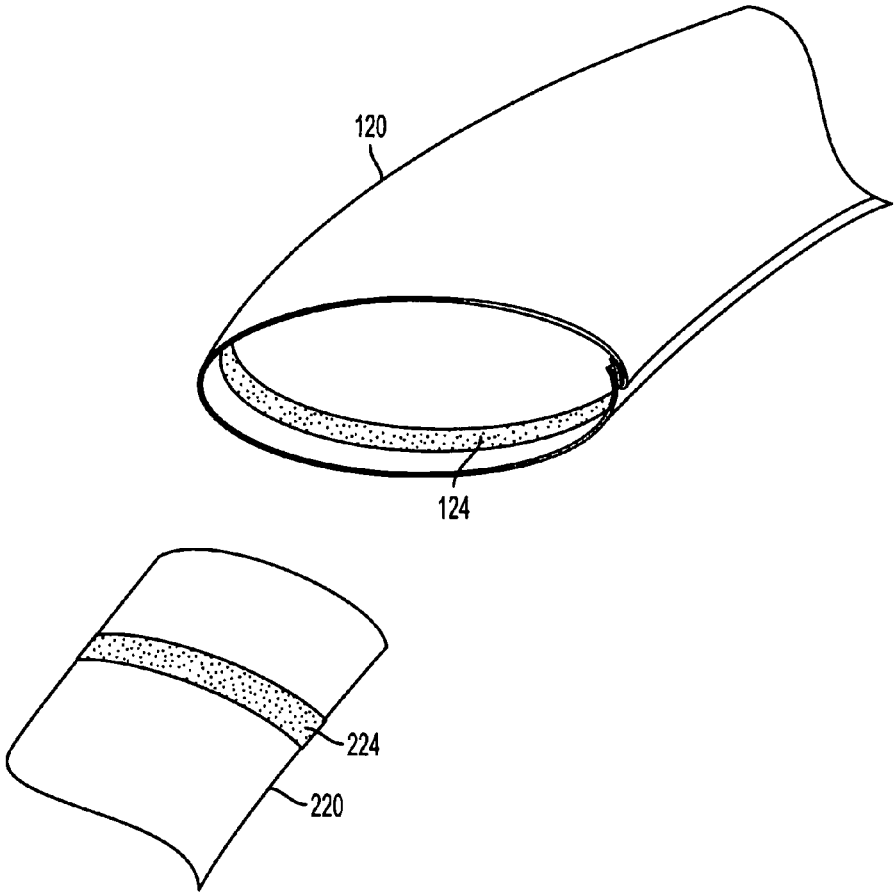
FIG. 4 is a perspective view of an interface between the leaf collection apparatus and the exhaust outlet of a leaf vacuum.

FIG. 4 illustrates an embodiment of the connection between intake hose 120 and leaf vacuum exhaust outlet 220. Many common leaf vacuums include a ring of hook-and-loop fastener material around the circumference of their exhaust outlets for the secure attachment of leaf collection bags. Therefore, in the embodiment of FIG. 4, leaf collection apparatus 100 is provided with ring 124 of hook-and-loop fastener material around the inside circumference of intake hose 120, adapted to be removably attached to ring 224 of hook and loop fastener material disposed around the exterior circumference of exhaust outlet 220.

Figure 5:
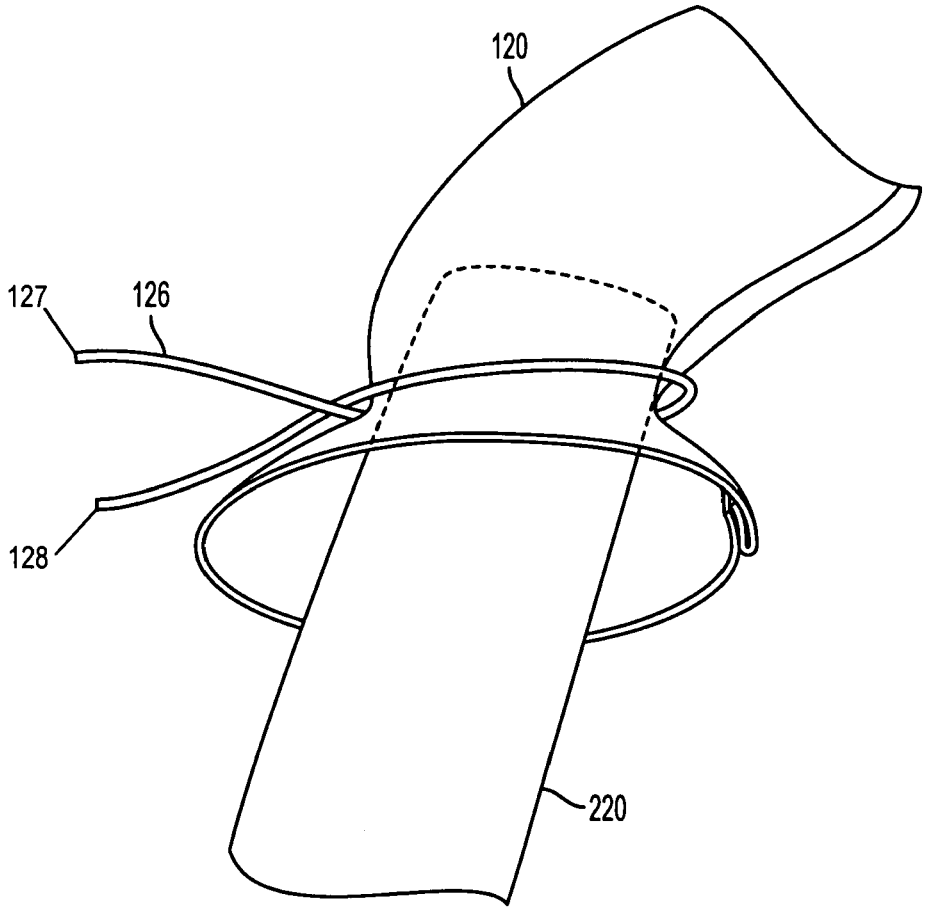
FIG. 5 is a perspective view of another interface between the leaf collection apparatus and the exhaust outlet of a leaf vacuum.

FIG. 5 illustrates an alternative embodiment of a connection between intake hose 120 and leaf vacuum exhaust outlet 220. In the embodiment of FIG. 5, exhaust outlet 220 is inserted through intake port 122, into intake hose 120, and secured in place via pinch clamp 126. Pinch clamp 126 is a conventional pinch clamp design. Clamp arms 127 and 128 can be squeezed together to open the clamp for insertion of exhaust outlet 220 into intake hose 120. When exhaust outlet 220 is in its operational position, clamp arms 127 and 128 can be released, whereupon arms 127 and 128 spring apart, constricting the pinch clamp aperture to secure intake hose 120 onto exhaust outlet 220.

Figure 6:
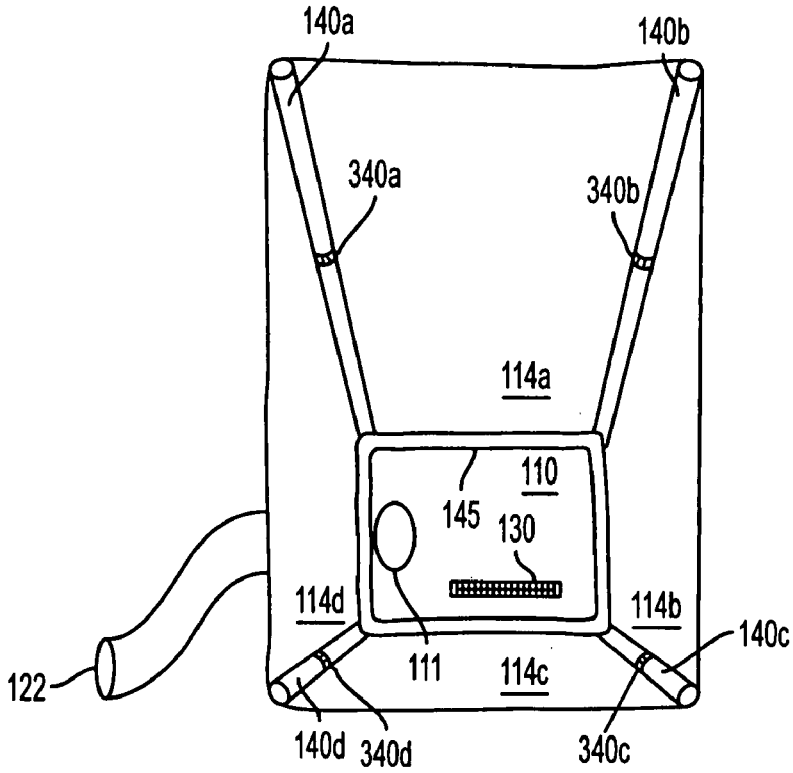
FIG. 6 is a perspective view of an alternative embodiment of the leaf collection apparatus, shown inverted and having hinged legs for facilitating storage of the apparatus.

While support legs 140 are illustrated in the embodiment of FIG. 2 as solid rigid rods, it is understood that alternative structures can be employed while still lending structural support to side walls 114 during operation within receptacle 200. For example, it may be desirable to include joints in one or more positions along the length of each leg to allow them to be folded for more compact storage of apparatus 100. Such an embodiment is illustrated in FIG. 6. Each support leg 140 includes a mechanical hinge 340 providing for the folding of legs 140. Legs 140 can be placed into a folded position such that the apparatus adopts a compact form for storage, and can be deployed into a substantially straight position during use.

The foregoing description and drawings merely explain and illustrate the invention, and the invention is not so limited as those skilled in the art who have the disclosure before them will be able to make modifications and variations therein without departing from the scope of the invention.

I claim:

1. An apparatus for facilitating the collection of leaves or other yard waste, and for use in connection with a portable vacuum device having a discharge outlet from which leaves or other yard waste can be expelled, the apparatus being adapted for insertion into a receptacle into which leaves or other yard waste is to be stored, the apparatus comprising:

a top surface;

side wall surfaces at least partially inserted into the receptacle, the side wall surfaces and top surface together defining an open-bottomed chamber;

an intake hose having an open first end capable of interconnection with the discharge outlet of the portable vacuum device, and a second end leading into the open-bottomed chamber formed by the top surface and side wall surfaces;

one or more support legs positioned along one or more side wall surfaces.

2. The apparatus of claim 1, in which top surface and side wall surfaces are comprised of a flexible woven material permeable to air but mostly impermeable to common leaves and yard waste.

3. The apparatus of claim 2, in which the flexible woven material is canvas.

4. The apparatus of claim 1, in which the top surface further comprises an access aperture which can alternatively occupy an opened position or a closed position, the access aperture providing physical access to the open-bottomed chamber when in the opened position.

5. The apparatus of claim 4, in which the access aperture is further comprised of a zipper.

6. The apparatus of claim 1, in which each of the one or more support legs is comprised of a rigid metal rod.

7. The apparatus of claim 1, in which each of the one or more support legs is comprised of a plurality of rod segments.

8. The apparatus of claim 7, in which each rod segment is attached to another rod segment via a mechanical hinge.

9. The apparatus of claim 1, in which the number of support legs is four, the side wall surfaces consist of four panels adjoined to form a cylinder having a quadrilateral cross section, and the support legs are positioned axially along the perimeter of the cylinder.

10. The apparatus of claim 1, the apparatus further comprising a top surface support member attached to the top surface.

11. The apparatus of claim 10, in which the top surface support member is comprised of a rigid metal rod material formed along the perimeter of the top surface.

12. The apparatus of claim 1, in which the intake hose is further comprised of a fastener at the first end adapted for removable interconnection with the discharge outlet of the portable vacuum device.

13. The apparatus of claim 12, in which the fastener is comprised of a first ring of hook-and-loop fastener material around the inside perimeter of the intake hose, whereby the first ring of hook-and-loop fastener material can be removably secured to a complementary second ring of hook-and-loop fastener material disposed around the outside perimeter of the discharge outlet.

14. The apparatus of claim 12, in which the fastener is comprised of a pinch clamp circumscribing the exterior perimeter of the intake hose.

15. A leaf collection apparatus, the apparatus comprising:

a portable vacuum device having a discharge outlet from which leaves and/or yard waste can be expelled;

a leaf conduit device adapted for insertion into a receptacle into which leaves or other yard waste is to be stored, the leaf conduit device further comprising a top surface; side wall surfaces at least partially inserted into the receptacle, the side wall surfaces and top surface together defining an open-bottomed chamber; an intake hose having an open first end capable of interconnection with the discharge outlet of the portable vacuum device, and a second end leading into the open-bottomed chamber formed by the top surface and side wall surfaces; and one or more support legs positioned along the length of a side wall surface.

16. A method of collecting leaves or other waste from a yard, the method comprising the steps of:

inserting into a leaf receptacle a leaf conduit device having a top surface and side walls forming an open-bottom chamber and an intake hose open at one end and leading into the open-bottom chamber at the other end;

attaching the discharge outlet of a portable vacuum device to the one end of the intake hose;

using the portable vacuum device to vacuum up leaves or other waste from the yard and to expel the leaves or other waste through the discharge outlet, through the intake hose and into the open-bottom chamber;

lifting the leaf conduit device out of the leaf receptacle, leaving the contents of the open-bottom chamber behind in the leaf receptacle.

* * * * *